US010537861B2

(12) United States Patent
Cobb

(10) Patent No.: US 10,537,861 B2
(45) Date of Patent: Jan. 21, 2020

(54) IN-LINE WELL FLUID EDUCTION BLENDING

(71) Applicant: ChemRight, LLC, Midland, TX (US)

(72) Inventor: Don B. Cobb, Houma, LA (US)

(73) Assignee: CHEMRIGHT, LLC, Midland, TX (US)

( * ) Notice: Subject to any disclaimer, the term of this patent is extended or adjusted under 35 U.S.C. 154(b) by 131 days.

(21) Appl. No.: 15/421,649

(22) Filed: Feb. 1, 2017

(65) Prior Publication Data

US 2017/0232407 A1 Aug. 17, 2017

Related U.S. Application Data

(60) Provisional application No. 62/294,708, filed on Feb. 12, 2016.

(51) Int. Cl.

| | |
|---|---|
| ***B01F 5/04*** | (2006.01) |
| ***B01F 3/08*** | (2006.01) |
| ***B01F 15/02*** | (2006.01) |
| ***B01F 15/00*** | (2006.01) |
| ***E21B 21/06*** | (2006.01) |

(52) U.S. Cl.

CPC ..... *B01F 5/043* (2013.01); *B01F 3/0865* (2013.01); *B01F 15/00136* (2013.01); *B01F 15/00246* (2013.01); *B01F 15/00422* (2013.01); *E21B 21/062* (2013.01)

(58) Field of Classification Search

CPC ..... B01F 5/043; B01F 5/0418; B01F 5/0425; E21B 21/062; F04F 5/10; F04F 5/12; F04F 5/467

See application file for complete search history.

(56) References Cited

U.S. PATENT DOCUMENTS

| | | | | |
|---|---|---|---|---|
| 4,007,921 | A * | 2/1977 | Zingg | B01F 3/12 366/10 |
| 5,954,452 | A * | 9/1999 | Goldstein | B01F 5/043 166/250.01 |
| 9,416,604 | B2 | 8/2016 | Cobb | |
| 2005/0006089 | A1* | 1/2005 | Justus | E21B 43/267 166/250.01 |
| 2008/0049544 | A1* | 2/2008 | Bingham | B01F 3/0446 366/101 |

(Continued)

FOREIGN PATENT DOCUMENTS

| | | |
|---|---|---|
| CA | 2849450 A1 | 7/2014 |
| WO | 2014113129 A1 | 7/2014 |

*Primary Examiner* — David J Bagnell
*Assistant Examiner* — Theodore N Yao
(74) *Attorney, Agent, or Firm* — Bracewell LLP; James E. Bradley

(57) ABSTRACT

A system and method of wellbore operations that uses an eductor unit for introducing additives into a moving fluid stream to form a mixture. The mixture is used as a completion drilling fluid for drilling through plugs installed in a wellbore. Example additives include polymers, such as friction reducers, viscosifiers, potassium chloride, polysaccharide, polyacrylamide, biocides, lubricants, long chain polymer molecules, and the like. The fluid is primarily fresh water and/or brine water, and acts as a motive fluid in the eductor unit for drawing the additive into the eductor unit. Forming the mixture in the eductor unit which is injected into the wellbore.

13 Claims, 4 Drawing Sheets

(56) References Cited

U.S. PATENT DOCUMENTS

| | | | | |
|---|---|---|---|---|
| 2009/0023614 | A1* | 1/2009 | Sullivan | C09K 8/68 507/214 |
| 2012/0324789 | A1* | 12/2012 | Pease | A01G 31/00 47/62 N |
| 2014/0000720 | A1* | 1/2014 | Mortzheim | F16K 24/00 137/1 |
| 2014/0202702 | A1* | 7/2014 | Cobb | B01F 5/0614 166/307 |
| 2014/0360934 | A1* | 12/2014 | Anker | B01F 5/0212 210/620 |
| 2015/0273546 | A1* | 10/2015 | Robinson | C02F 1/685 210/747.8 |

* cited by examiner

IN-LINE WELL FLUID EDUCTION BLENDING

CROSS REFERENCE TO RELATED APPLICATIONS

This application is a continuation of, and claims priority to and the benefit of U.S. Provisional application Ser. No. 62/294,708 filed Feb. 12, 2016, the full disclosure of which is hereby incorporated by reference herein in its entirety and for all purposes.

BACKGROUND OF THE INVENTION

1. Field of Invention

The present disclosure relates in general to injecting fluid into a well, and in particular to methods and devices that blend additives to the fluid in an eductor.

2. Description of Prior Art

Fluids are often injected into wells during various wellbore operations, such as during drilling, pump down procedures, or hydraulic fracturing ("fracing"). A blender is typically provided at the well site during the fracing process for mixing chemicals, water, and proppant. The chemicals generally include friction reducers and viscosity enhancers. The blender feeds the mixture to high pressure pumps for pressuring the mixture to pressures that often approach 10,000 psi; the pressurized mixture is then injected into the well to create fractures.

Completion of a well typically involves perforating through casing that lines the wellbore, where perforating generally starts at a lowermost depth in the wellbore, and is sequentially performed at reduced depths up the wellbore. Plugs are generally installed in the wellbore above each set of perforations. It is not uncommon for an operator to create twenty or more sets of perforations, and install twenty or more plugs in a well. The plugs are usually removed with a drilling system. High pressure completion drilling fluid is often circulated through the wellbore while the plugs are being drilled. Typical drilling pressures are in the range of 2500 to 5000 psi, and the flow rates are usually at least 100 gpm (gallons per minute). The fluid flow rate and pressure is controlled so that the drilled plug fragments flow out of the wellbore entrained within the completion drilling fluid. To enhance the flow of the completion drilling fluid, friction reducers, chemicals, or viscosifiers such as liquid gelling agents are added to the well fluid in a blender. The friction reducers and viscosifiers are normally polymers. After a designated viscosity has been reached, the drilling fluid is directed from the blender to the high pressure pumps. Blending can be time consuming, which adds to the total time to drill out the wells containing the temporary frac plugs.

Mixing devices and systems such as low, or zero, pressure surface blending systems, low pressure batch mixing systems, low pressure surface hydration systems and other such systems primarily depend on time. Conventional blenders use atmospheric tanks, static mixers, internal stirring paddles, and/or some form of non-positive suction and/or displacement high pressure jetting. The blending unravels and shear stresses component molecules of the chemicals being introduced. Blending is done in efforts to bring multiple components ultimately into one homogeneous and consistent blend of quality product with enhanced chemical and physical characteristics. Atmospheric blending generally requires at least two hours to achieve hydration rates of around 90%.

SUMMARY OF THE INVENTION

Disclosed herein is an example method of wellbore operations that includes providing an eductor unit having a housing, an axial bore in the housing, a jet nozzle in the bore, the jet nozzle having an inlet and an outlet, and an inner diameter that reduces with distance away from the inlet. An annular space is formed between an outer surface of the jet nozzle and inner surface of the axial bore, an eductor port is adjacent the annular space that extends through the housing, and a profile is on an inner surface of the housing adjacent the outlet of the jet nozzle and that defines a venturi. The method includes directing a flow of fluid into the inlet of the jet nozzle, so that the fluid flow exits the outlet of the jet nozzle and generate a low pressure zone in the annular space, and forming a mixture by providing communication between an additive and the port, so that the additive is drawn into the annular space and combines with the fluid. In an example, the method further includes directing the mixture into a wellbore to wash plug cuttings from the wellbore. The method optionally further includes directing the mixture through a drill string, so that the mixture discharges from a drill bit on an end of the drill string. Further in this example, the drill string can be coiled tubing or jointed pipe tubulars. In an alternative, multiple eductor ports are included. In an embodiment, the method further includes directing different additives through different eductor ports. In one alternative, the additive is controllingly dosed through the eductor port. An example exists where some of the fluid is bypassed around the jet nozzle. By monitoring a viscosity of the mixture, an amount of the additive combined with the fluid can be regulated based on a monitored value of the viscosity.

Also disclosed herein is a system for use in wellbore operations that includes an upstream line in communication with a source of a wellbore treatment fluid, a downstream line in communication with the wellbore, and an eductor unit. In this example the eductor unit is made up of a housing, an inlet in communication with the upstream line, an exit in communication with the downstream line, a jet nozzle in the housing that defines an annular space between the jet nozzle and an inner surface of the housing, and a port that extends through a sidewall of the housing adjacent the annular space, and that is in selective communication with a source of additive, so that additive drawn into the annular space mixes with the well treatment fluid in the housing to form a mixture. The system can further include a plurality of ports that are each in communication with different sources of additive. The system can optionally include a control valve for regulating a flow of additive to the eductor unit. A profile can optionally be included in a portion of the housing downstream from the jet nozzle, wherein the profile defines a venturi. Examples exist where the additive and wellbore treatment fluid are combined in the eductor unit to form a mixture. Alternatives exist where a sensor is included that is in contact with the mixture, and where the sensor senses a viscosity of the mixture, or where an external sensor that is not in direct contact with the mixture senses the flow rate of the additive being pulled into the mixture inside the eductor unit. Pumps can optionally be included in the downstream line that pressurize the mixture. In an alternative, a mixing device is in the downstream line that is between the pumps and the wellbore.

BRIEF DESCRIPTION OF DRAWINGS

Some of the features and benefits of the present invention having been stated, others will become apparent as the description proceeds when taken in conjunction with the accompanying drawings, in which.

Figure 1:
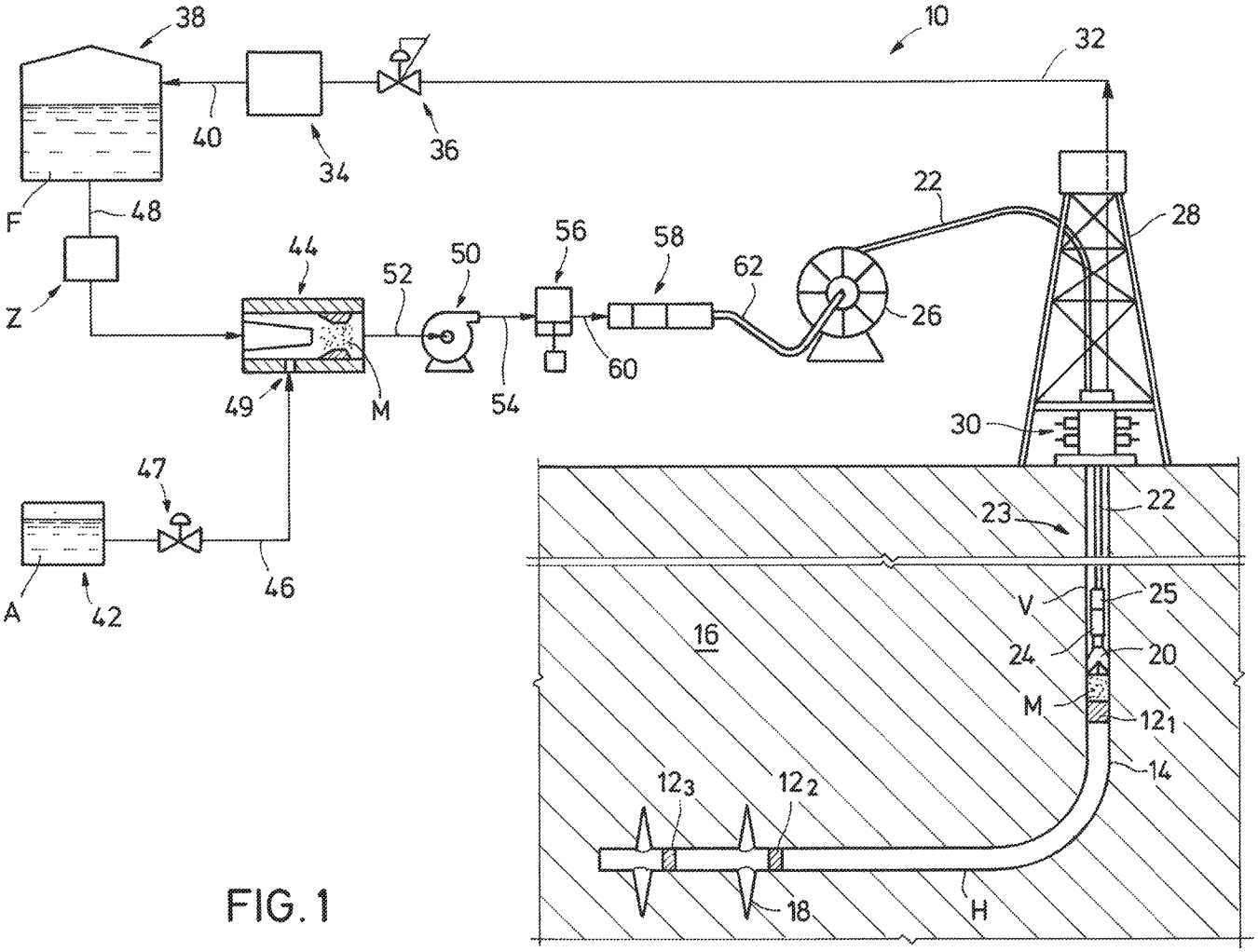
FIG. 1 is a side partial sectional view of an example of a plug removal system for use with a wellbore.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows in a side partial sectional view one example of a plug removal system 10 for removing plugs $\mathbf{12}_1$, $\mathbf{12}_2$, $\mathbf{12}_3$ shown disposed within a wellbore 14. Wellbore 14 intersects a subterranean formation 16, and is shown having a vertical portion V, and a horizontal portion H. As shown, plug $\mathbf{12}_1$ is in the vertical portion V, whereas plugs $\mathbf{12}_2$, $\mathbf{12}_3$ are in the horizontal portion H of wellbore 14. Perforations 18 are shown projecting radially outward from wellbore 14 and into formation 16 which provide a pathway for connate fluid within formation 16 to flow into wellbore 14. Optionally, formation fractures (not shown) may be included within formation 16 that were hydraulically generated by pressurizing wellbore 14, such as with a fracturing fluid. Plug removal system 10 is shown having a drill bit 20 disposed in wellbore 14 and being lowered towards plug $\mathbf{12}_1$ for drilling out and removing plug $\mathbf{12}_1$. In the example, plugs $\mathbf{12}_1$-$\mathbf{12}_3$ can be formed from any material used in plugging or pressure isolating portions of the wellbore 14, such as but not limited to various types of composites and elastomers. Drill bit 20 is mounted on an end of coiled tubing 22 (or other drilling tubular), where the bit 20 and tubing define a drill string 23. Optionally included with the drill string 23 is a mud motor 24 that attaches between the end of the coiled tubing 22 (or other drilling tubular) and bit 20. Carrying tools 25 may alternatively be included that are shown mounted on the string 23 upstream of the mud motor 24. Mud motor 24 rotates the bit 20 downhole so that bit 20 can excavate through the plugs $\mathbf{12}_1$-$\mathbf{12}_3$. Alternative devices on surface may rotate the drill string 23 eliminating the need of the mud motor 24. A reel 26 is shown on surface for storing the coiled tubing 22; in coiled tubing operations unwinding tubing 22 from reel 26 deploys bit 20 deeper within wellbore 14. Optionally, an oil rig 28 is shown provided over the opening of wellbore 14 on surface, and from which sections of drill pipe may be used in place of the tubing 22. In an alternative, a blowout preventer ("BOP") 30 is provided on surface and at the opening of wellbore 14 for providing positive well control during operations within wellbore 14.

In one embodiment, the bit 20 includes nozzles that discharge a mixture M of completion drilling fluid. After the mixture M is discharged from bit 20, fragments of the drilled plugs $\mathbf{12}_1$-$\mathbf{12}_3$ become entrained in the mixture M. The pressure of the mixture M exiting the bit 20 is sufficient to circulate the completion drilling fluid up the wellbore 14, through BOP 30, and into a return line 32. In the return line 32, the mixture M with fragments is directed to a solids removal system 34 for processing to remove particulate matter and solids within the mixture M, such as the cuttings from drilling though the plugs $\mathbf{12}_1$-$\mathbf{12}_3$. A pressure control valve 36 is shown installed in return line 32 for maintaining a back pressure against pressure in wellbore 14, formation 16, and in return line 32. Removing the solids and particulate matter from the completion drill fluid forms a conditioned well fluid defined as fluid F. A storage tank 38, via line 40, receives fluid F discharged from solid removal system 34.

Still referring to FIG. 1, as described below fluid F mixes with an additive A to form mixture M. In one example fluid F is made up substantially by weight of fresh water and/or brine water, and can contain trace amounts (i.e. less than 1.0 percent by weight) of other substances, including but not limited to particles of plug cuttings, and trace amounts of additive A not removed in the solids removal system 34. In the illustrated example, additive A is stored within an additive storage vessel 42 and is directed to an eductor unit 44 via line 46. An optional control valve 47 regulates flow of the additive through line 46. In a non-limiting example, regulating flow through line 46 includes allowing an unimpeded flow of additive in line 46 (i.e. 100% of a maximum flow), fully impeding a flow of fluid in line 46 (i.e. 0% of a maximum flow), and partially impeding flow in line 46 so that a flow rate in line 46 is between 0% and 100% of a maximum flow. Fluid F is directed to eductor unit 44 within line 48, whose opposing ends are shown connected to tank 38 and eductor unit 44. An optional in-line filtration device or centrifugal sand/debris separator Z is shown placed in line 48 and between the fluid storage tank 38 and eductor unit 44 to polish and finish the debris removal process of the completion drilling fluid F prior to being reintroduced in the wellbore operations. Line 46 is schematically shown coupled to an education port 49 that projects through a sidewall of eductor unit 44. Additive A exits line 46, flows through inject port 49, and into eductor unit 44 for mixing with the fluid F. It should be pointed out that embodiments exist wherein more than one type of additive A is mixed with the fluid F within eductor unit 44. Thus multiple additive storage vessels 42, or multiple compartments within additive storage vessel 42, may be provided for storing of different additives A to be mixed with fluid F. Further optionally, embodiments exist wherein eductor unit 44 includes multiple education ports 49, or where multiple additives are injected into a manifold (not shown) that is in communication with a single port 49. Examples of additives include friction reducers, viscosifiers (such as polyacrylamide and polysaccharide), potassium chloride, Xantham gum polymer, hydroxyethyl cellulose polymer, guar gum polymer, biocides, lubricants, long chain polymer molecules, ethylene glycol, methanol, isooctyl alcohol, xylene, ethylbenzene, kerosene, dihydroxyaluminum stearate, fatty acids, poly (acrylamide-co-sodium acrylate, ammonium bisulfate, isopropanol, 3-(tridecyloxy)-2-hydroxypropyltrimethyl ammonium, 1-dodecanesulfonic acid, hydroxyl-sodium salt, dodecene-1-sulfonic acid, glutaraldehyde, 2-propenoic acid, polymer with 2-propenamide, sodium chloride, C12-C14 isoalkanes, and the like, and combinations thereof. Additives can be obtained from Rockwater Energy Solutions, 515 Post Oak Boulevard, Suite 200, Houston, Tex. 77027, 713-235-9500.

In the example of FIG. 1, mixture M exits eductor unit 44 and is directed to a transport pump 50 via line 52. In one example transport pump 50 is a centrifugal pump, and discharges the mixture M into line 54 at a pressure sufficient to overcome dynamic losses in lines 48, 52, 54, which in an example is around 40 pounds per square inch ("psi") to around 100 psi. Mixture M discharged from the transport pump 50 is directed to an injection pump 56 within line 54. Examples of the injection pump 56 include a high pressure positive displacement pump that pressurizes the mixture M up to about 10,000 psi. Optionally, mixture M after being discharged from injection pump 56 is directed to a high pressure mixing device 58 via line 60. One example of a high pressure mixing device 58 is provided in U.S. patent application Ser. No. 14/075,436 filed Nov. 8, 2013, which is assigned to the owner of this application, and which is incorporated by reference herein in its entirety for all purposes. An advantage of the high pressure mixing device 58 installed between lines 60 and 62 is that the need for surface atmospheric, or other such low pressure mixing devices is eliminated, thereby allowing for real time positive displacement homogenous mixing and blending. Another advantage of the device 58 is near instantaneous full hydration of additive polymers under pressure while mixture M is heading towards the drill string 23, and ultimately exiting the bit 20. A feedline 62 is shown having an end attached to a discharge of mixing device 58 and which provides fluid communication between mixing device and coiled tubing 22 wound on reel 26. Thus in an example, the mixture M is injected into the well 14, via coiled tubing 22 (or other drilling tubular) and used for removing cuttings or other particulate matter when drilling through the plugs $\mathbf{12}_1$-$\mathbf{12}_3$.

Figure 2:
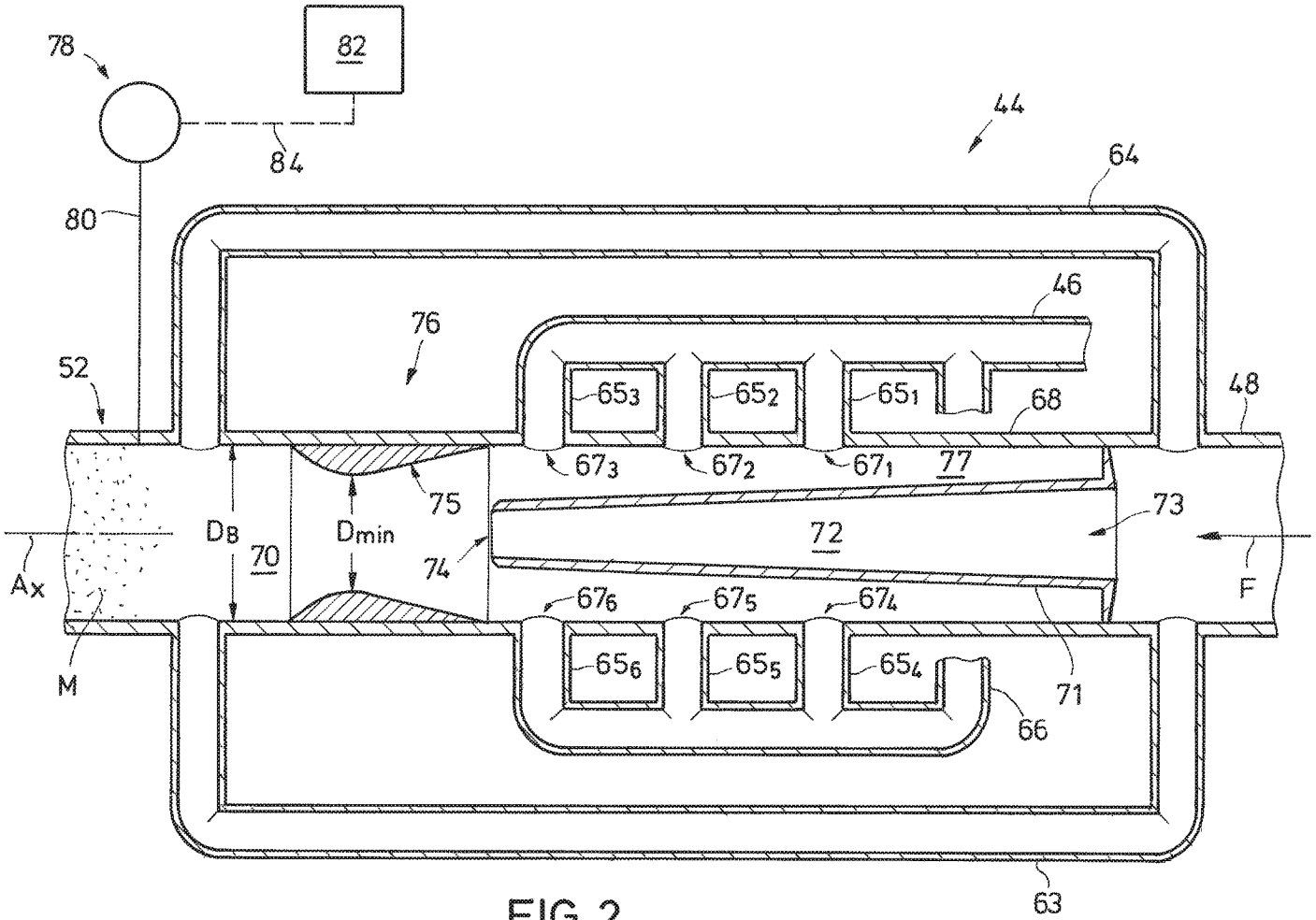
FIG. 2 is a schematic view of an example of an eductor unit for use with the plug removal system of FIG. 1.

Referring now to FIG. 2, shown in schematic view is an example of the eductor unit 44, where bypass lines 63, 64 divert a portion of the fluid F entering eductor unit 44. As shown, lines 63, 64 each have an inlet end connected to line 48, and an exit end connected to line 52. Also shown are leads $\mathbf{65}_1$-$\mathbf{65}_3$ which have inlets connected to line 46, and leads $\mathbf{65}_4$-$\mathbf{65}_6$, which have inlets connected to line 66. In the illustrated example, line 66 branches from line 46 so that additive flowing in line 46 can be delivered to leads $\mathbf{65}_4$-$\mathbf{65}_6$. Leads $\mathbf{65}_1$-$\mathbf{65}_6$ respectively register with ports $\mathbf{67}_1$-$\mathbf{67}_6$ that extend through a sidewall of a housing 68. Housing 68 is an annular member shown provided generally coaxially in the eductor unit 44, and that extends from where bypass lines 63, 64 intersect line 48 to where bypass lines 63, 64 intersect line 52. Thus in the example of FIG. 2, bypass lines 63, 64 carry an amount of fluid F around housing 68. A bore 70 is shown extending axially through housing 68 thereby providing fluid communication between line 48 and line 52. A jet nozzle 71 is disposed within housing 68 having a passage 72 extending axially through the jet nozzle 71. An inlet 73 to the passage 72 is shown disposed in a portion of housing 68 proximate to line 48, and which receives a portion of the flow of fluid F from line 48 not diverted to bypasses 63, 64. Fluid F entering jet nozzle 71 through the inlet 73, flows through the passage 72 and exits through an outlet 74 shown on an end of nozzle 71 distal from inlet 73. In the example of FIG. 2, outlet 74 of jet nozzle 71 has a cross-sectional area that is smaller than or equal to a cross-sectional area of the inlet 73 to jet nozzle 71. In one embodiment, the outlet 74 of jet nozzle 71 has a cross-sectional area that is greater than the cross-sectional areas of bypass lines 63, 64. Bypass lines 63, 64 can have the same or different cross sectional areas. Examples exist wherein bypasses 63 and 64 are operable bypasses, and depending on desired flow through jet nozzle 71, may either fully open or closed on demand with various types of flow control devices (not shown), such as but not limited to, ball valves.

A profile 75 is shown that extends axially along a portion of the sidewalls of bore 70 and proximate the outlet 74 of jet nozzle 71. An inner surface of profile 75 follows a path that is generally oblique to an axis $A_X$ of bore 70 and radially inward from sidewalls of bore 70. At an axial distance downstream from outlet 74, the inner surface of profile 75 transitions radially outward towards sidewalls of bore 70 and along a path oblique to axis $A_X$. At the transition the profile 75 has a maximum radial thickness, which forms a minimum diameter $D_{min}$ within bore 70. An angle between the surface of profile 70 and axis $A_X$ downstream of transition is greater than an angle between surface of profile 70 and axis $A_X$ upstream of transition. The profile 75 thus reduces flow path diameter in the bore 70 from a maximum diameter $D_B$ to minimum diameter $D_{min}$, and back to maximum diameter $D_B$. The changes in diameter of the bore 70 define a venturi 76 within bore 70. As such, the restricted diameter of the venturi 76 causes a localized increase in velocity of the fluid F flowing within bore 70, which in turn generates a localized reduced pressure. An annular space 77 shown between the sidewalls of bore 70 and outer radius of jet nozzle 71 also experiences a localized reduced pressure. Reducing the pressure in the annular space 77 creates a pressure differential between the annular space 77 and line 46, which induces a flow of additive A through ports $\mathbf{67}_1$-$\mathbf{67}_6$ into annular space 77.

Figure 2A:
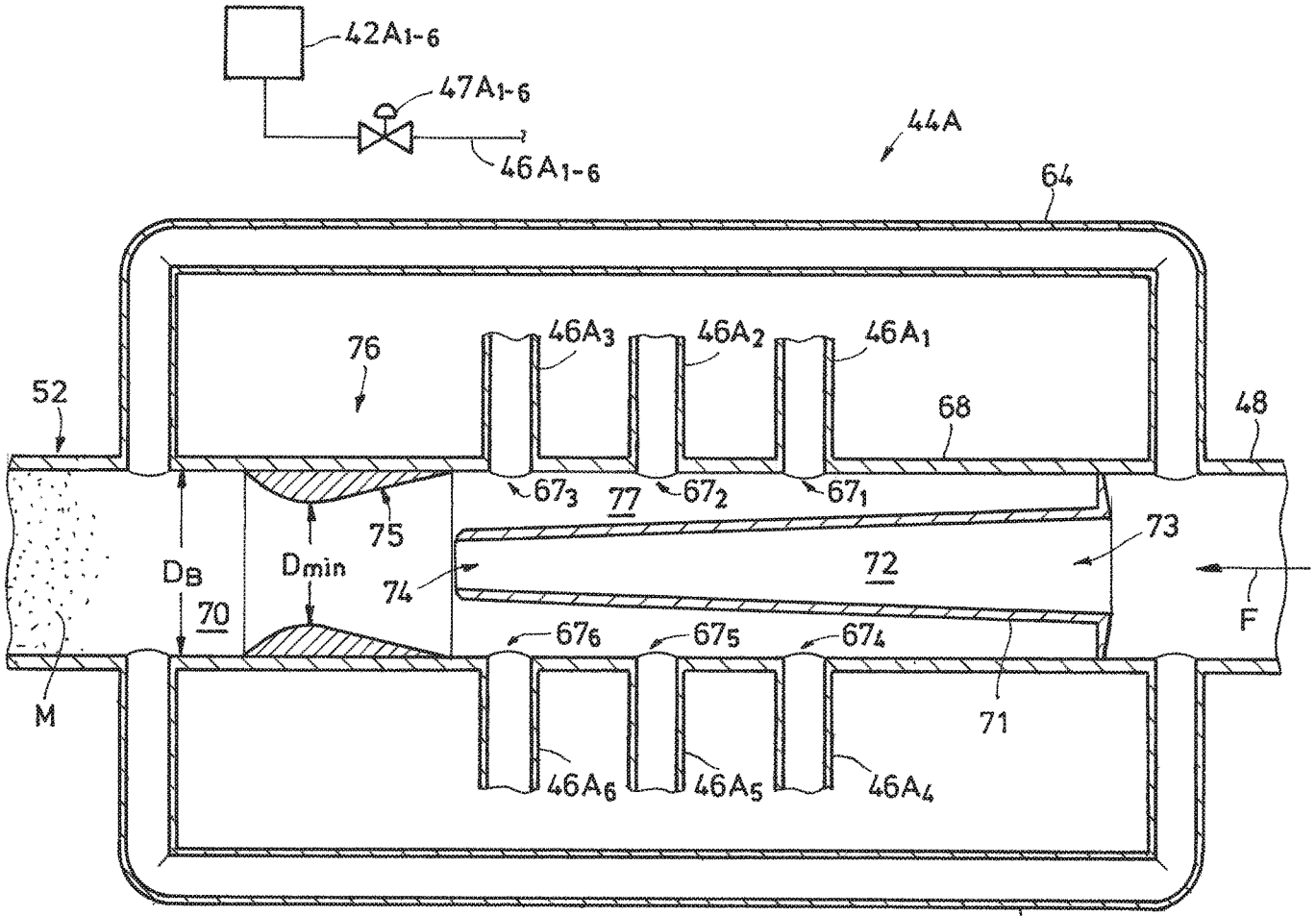
FIGS. 2A and 3 are schematic views of alternate examples of eductor units for use with the plug removal system of FIG. 1.

Shown in FIG. 2A is an alternate example of eductor unit 44A, where additive flowing through each of the ports $\mathbf{67}_1$-$\mathbf{67}_6$ can be different, which is unlike the embodiment of FIG. 2 wherein the additive in each port $\mathbf{67}_1$-$\mathbf{67}_6$ is the same. In the embodiment of FIG. 2A, dedicated lines $\mathbf{46}A_1$-$\mathbf{46}A_6$ have inlet ends coupled with storage vessels $\mathbf{42}A_1$-$\mathbf{42}A_6$, and outlet ends that register respectively with ports $\mathbf{67}_1$-$\mathbf{67}_6$. Control valves $\mathbf{47}A_1$-$\mathbf{47}A_6$ are shown respectively on lines $\mathbf{46}A_1$-$\mathbf{46}A_6$ and that regulate flow through the lines $\mathbf{46}A_1$-$\mathbf{46}A_6$. Thus depending on a particular application, a same or different additive is injected into the eductor unit 44, 44A. Examples exist wherein valving (not shown) is installed that allow for selective changing between injecting the same or different additives. Further, in one example, the lines $\mathbf{46}A_1$-$\mathbf{46}A_6$ connecting to each of the ports $\mathbf{67}_1$-$\mathbf{67}_6$ can include control valves (not shown) for regulating the volumetric flow rate of additives through the education ports $\mathbf{67}_1$-$\mathbf{67}_6$.

The feedback for determining the flow through lines 46, 48 (FIG. 2) can be gained from monitoring conditions of the mixture M downstream of eductor unit 44, or at the discharge end of eductor unit 44. For example, if a viscous fluid makes up one of the additives A being injected via education ports $67_1$-$67_6$, monitoring the viscosity of the mixture M real time can provide a basis for adjusting a flow rate of the viscous fluid additive. An example of a monitoring system is shown with an indicator 78 mounted on a probe 80 that is in communication with the mixture M in line 62. Probe 80 includes sensing means that monitors information about the fluid, such as but not limited to fluid conditions, characteristics, and/or properties. Signals representing the sensed fluid information is transmitted to a controller 82 via a communication means 84. In an example, controller 82 includes an information handling system, which contains a processor, memory accessible by the processor, nonvolatile storage area accessible by the processor, and logics for performing each of the steps above described. Examples exist where communication means 84 includes an electrically conducting medium, means for wireless communication, fiber optics, and combinations thereof. In one non-limiting example of operation, logics direct controller 82 to change an amount of additive being dispensed to the eductor unit 44 based on fluid information sensed by the monitoring system. In an embodiment, controller 82 provides instructional commands to control valve 47 (FIG. 2), or control valves $47A_1$-$47A_6$ (FIG. 2) to regulate the amount of additive being dispensed to eductor units 44, 44A. In an example, changing the amount of additive includes reducing a flow rate of the amount of additive, or increasing a flow rate of the amount of additive. Conversely, an external electronic digital monitoring sensor and electronic readout (not shown) that senses the flow rate of additive A through line 46, but that is not in direct contact with additive A or mixture M, can be mounted on additive storage vessel 42 or on line 46. Alternatively the sensor can monitor an internal drainage rate of the additive storage vessel 47. In this example, a volumetric versus timed dosage flow rate of additive A can be released into the eductor via line 46 in a controlled dosage fashion using control valve 47, the electronic readout and operation of control valve 47 can either be hands on or remotely controlled via electronics.

One of the advantages of the mixing of the additive A and fluid F within the eductor unit 44 is that particular additives can be controllingly dosed into the stream of fluid F flowing within the eductor unit 44. In certain embodiments when used in conjunction with the high pressure mixing device 58, completion drilling fluid additives are homogenously mixed, blended and the polymers hydrated near instantaneously. An example of near instantaneously is from about 10 seconds to about 15 seconds or less. One non-limiting example of hydration is defined by the absorption of water into the polymeric molecule, or cleavage of water into the polymeric molecule; thus embodiments exist where the greater the absorption, the higher the yield of the polymer. In contrast, traditional ways of hydrating particular polymers may require multiple hours of blending, mixing, and shear stressing. The additive A is added to the fluid F over a period of time when forming the mixture M in the eductor unit 44; thus the flowrate of additive A into the eductor unit 44 is less than that of the known method of dumping all of the additive into a mixing vat. The reduced flow rate of the additive of the present disclosure is believed to be due to efficiency of hydration percentage when used in conjunction with the high pressure inline mixer 58. Accordingly, as described above and illustrated in the figures, combining the additive A with fluid F in the confines of the eductor unit 44, and used in conjunction with the high pressure inline mixer 58, increases initial contact surface area between the additive A and fluid F, thereby significantly and unexpectedly increasing the rate of hydration over previously known methods.

In one alternative, the percent hydration of the additives A in the fluid F is estimated by measuring viscosity of the mixture M, and correlating the measured viscosity with a value of hydration. Example methods of measuring hydration rates of additive A verses percentage of polymer by volume of mixture M include using field hand held devices, one of which is a marsh funnel viscosity measurement devices or viscometers, such as the Viscolite 700, manufactured by Hydramotion, which measures the dynamic viscosity in centipoise. Information on the Viscolite 700 can be obtained from Nelson Systems, sys.nelsontech.com. A non-limiting example of hydration rates achieved within the high pressure inline mixer 58 when utilizing the eductor unit 44 include up to about 98% hydration, 96% hydration, 92% hydration, 90% hydration, 88% hydration, 86% hydration, and all values between these listed values. In one embodiment, 100% hydration occurs when the molecules making up the additive being hydrated have become fully associated, or cleaved, with an amount of water molecules such that the molecules making up the additive being hydrated cannot become associated with any more or any additional water molecules. Not only is there a tremendous time savings with the eductor unit 44, but capital costs can be significantly reduced as blender units are significantly more expensive than the piping and hardware of an example of the eductor unit 44.

Figure 3:
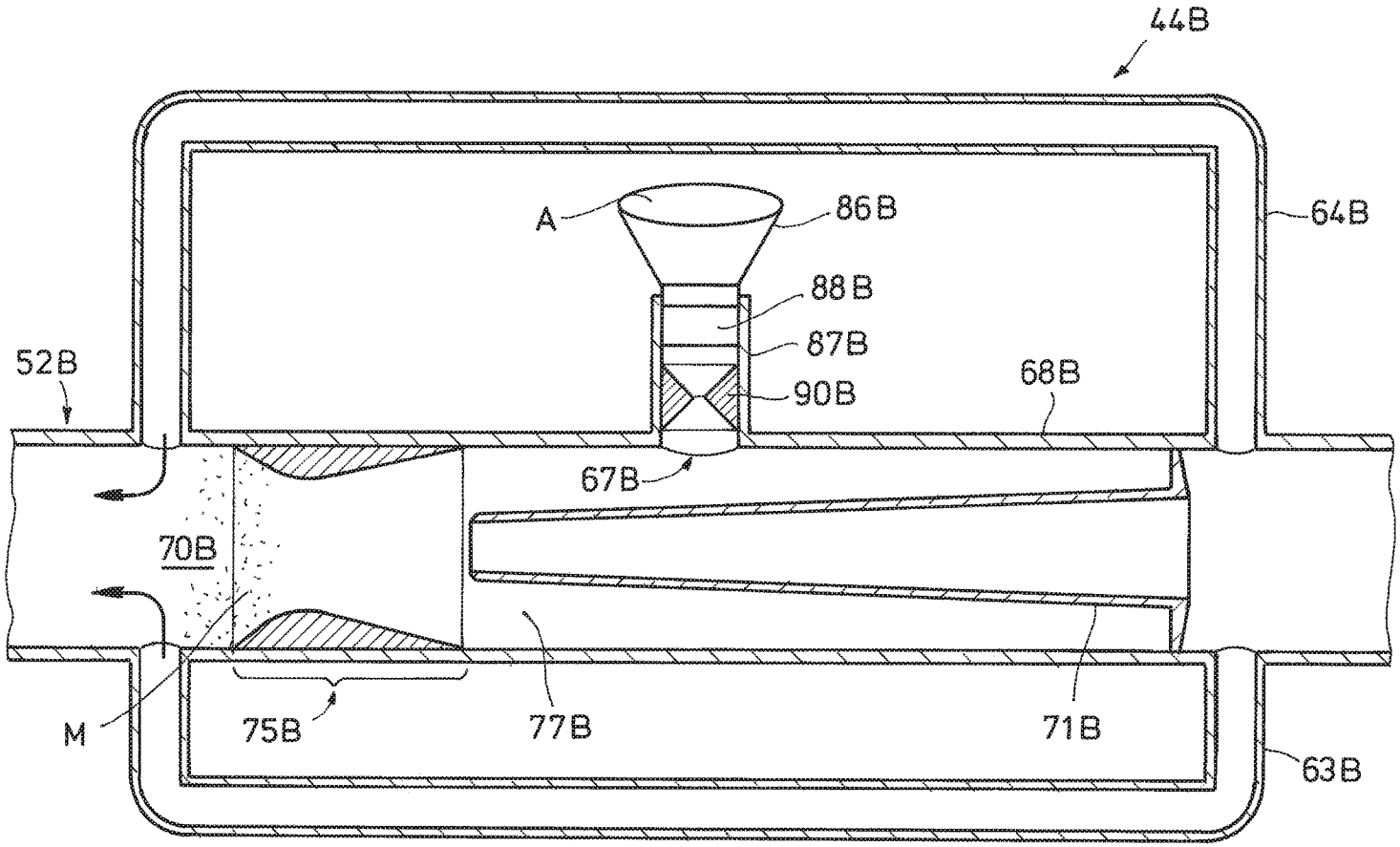

FIG. 3 shows in a side partial sectional view an alternate example of an eductor unit 44B and having bypasses 63B, 64B which direct some of the fluid F being introduced via line 46B to make its way directly to line 52B. This diverts some of the fluid F around the housing 68B of eductor unit 44B. In the example of FIG. 3, a single port 49B is shown for delivering additive A into annular space 77B for mixing with fluid F to create mixture M. Additive A is shown being stored within a hopper 86B, and dispensed from hopper 86B into a conduit 87B by selectively operating an on/off valve 88B shown mounted within conduit 87B. An end of conduit 87B opposite from its connection to hopper 86B registers with port 67B that is formed through a sidewall of housing 68B. A control valve 90B is shown in conduit 87B and on a side of valve 88B distal from hopper 86B. However, examples exist wherein control valve 90B is disposed between valve 88B and hopper 86B. In the embodiment of FIG. 3, when valve 88B is in the open position, control valve 90B regulates a flow of additive A from hopper 86B and into annular space 77B. Monitoring the level of additive A within hopper 86B over time, and comparing the changing level with metered marks provided on the wall of the hopper 86B, a flow rate of the additive A into the annular space 77B can be estimated. If the observed flow rate of additive A is different from a designated flowrate of additive A, the control valve 90B can be adjusted so that the designated flowrate of additive A is delivered to the annular space 77B. In one example, the designated flowrate of additive A is so that mixture M has a particular amount of additive A being mixed with fluid F to achieve designated properties of the mixture M. In one example, control valve 90B is a diaphragm-type pinch valve whose opening can be adjusted with a hand wheel manually, which can be obtained from Red Valve, www.redvalve.com, Red Valve Company 600 N. Bell Ave., Bldg. 2, Carnegie, Pa. 15106.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the embodiments of FIGS. 2, 2A, and 3 can be combined, either in series or in parallel to form a system for introducing additives into a fluid to be injected into a wellbore. These and other similar modifications will readily suggest themselves to those skilled in the art, and are intended to be encompassed within the spirit of the present invention disclosed herein and the scope of the appended claims.

What is claimed is:

1. A system for use in wellbore operations comprising:

an upstream line for communication with a source of a wellbore treatment fluid;

a downstream line for communication with the wellbore;

an eductor unit comprising, a housing having a longitudinal axis and an inward-facing sidewall extending around the axis and along a length of the axis, an inlet in the housing and in communication with the upstream line, an exit in the housing and in communication with the downstream line, a jet nozzle in the housing having a forward end proximate to the inlet, and a discharge end distal from the inlet for receiving and discharging wellbore treatment fluid flowing into the inlet of the housing, the jet nozzle having an outward-facing sidewall extending around the axis, an annular space defined between the outward-facing sidewall of the jet nozzle and the inward-facing sidewall of the housing, the annular space extending from the forward end to the discharge end of the jet nozzle, the annular space having a cross-sectional area that uniformly increases from the forward end of the jet nozzle to the discharge end of the jet nozzle, a first port that extends through the inward-facing sidewall of the housing into the annular space and is spaced a distance axially upstream from the discharge end of the jet nozzle, and for delivering a first additive that is in selective communication with a source of first additive, a second port that extends through the inward-facing sidewall of the housing into a larger cross-sectional portion of the annular space than the first port, the second port being spaced a distance axially downstream from the first port and upstream from the discharge end of the jet nozzle, for delivering a second additive that is in selective communication with a source of second additive, so that the second additive drawn into the annular space mixes in the annular space with the first additive and the well treatment fluid in the housing to form a mixture, and a venturi in communication with the annular space and disposed downstream of the discharge end of the jet nozzle.

2. The system of claim 1, wherein the second additive is different from the first additive.

3. The system of claim 1, further comprising a bypass line having a first end connected to the upstream line, and a second end connected to the downstream line.

4. The system of claim 1, further comprising a profile in a portion of the housing downstream from the jet nozzle that defines the venturi, wherein the venturi has a minimum diameter, wherein the profile upstream of the minimum diameter defines an upstream profile portion, and the profile downstream of the minimum diameter defines a downstream profile portion, wherein the upstream profile portion has a linear slope and the downstream profile portion has a curved slope, and the upstream profile portion has a greater axial dimension than the downstream profile portion.

5. The system of claim 1, further comprising an external flange on the forward end of the nozzle that extends from the outward-facing sidewall of the nozzle to the inward-facing sidewall of the housing, defining a forward end of the annular space.

6. The system of claim 1, wherein one of the inward and outward-facing sidewalls is conical and the other is cylindrical.

7. The system of claim 1, further comprising a device in the downstream line that is between the eductor unit and the wellbore, wherein mixing, blending, and hydrating of a fluid occur in the device.

8. The system of claim 1, further comprising first and second flow meters, each for measuring a flowrate of the first and second additives, respectively, through the first and second ports.

9. The system of claim 1, further comprising a return line having an upstream end in communication with fluid flowing from the wellbore, and a downstream end in communication with a storage tank having a motive fluid, wherein the motive fluid is selectively directed to the jet nozzle.

10. A system for use in wellbore operations comprising:

a feed line having a wellbore treatment fluid;

a discharge line in communication with a wellbore; and an eductor unit comprising:

a housing having a sidewall with a longitudinal axis, a jet nozzle disposed in the housing and having an inlet in communication with the feed line, and an outlet in communication with the discharge line, the jet nozzle having a sidewall that is coaxial with the longitudinal axis and extends from the inlet to the outlet of the jet nozzle, an annulus formed between the sidewall of the housing and the sidewall of the jet nozzle, the annulus extending axially from the inlet to the outlet of the jet nozzle, the annulus increasing in cross-sectional area with distance from the inlet of the jet nozzle, first and second ports that are formed through the sidewall of the housing into the annulus and along a length of the housing between the inlet and outlet of the jet nozzle for delivering first and second additives into the annulus, the first port leading to a smaller cross-sectional area portion of the annulus than the second port; and a venturi in the discharge line.

11. The system of claim 10, further comprising first and second additive lines that selectively carry first and second additives, respectively, to the first and second ports, respectively, and first and second tanks that contain the first and second additives, respectively, wherein each additive line has an end coupled with one of the ports and another end coupled with one of the tanks, and wherein the first additive is different from the second additive.

12. A system for use in wellbore operations comprising:

a feed line for receiving a flow of wellbore treatment fluid;

a discharge line for communication with a wellbore; and an eductor unit comprising, a housing having a cylindrical inward-facing sidewall extending around a longitudinal axis, a jet nozzle disposed in the housing along the longitudinal axis, the jet nozzle having an inlet in communication with the feed line and an outlet in communication with the discharge line, the jet nozzle having a conical outward-facing sidewall that is coaxial with and spaced radially inward from the inward-facing sidewall of the housing, defining an annulus between the inward-facing sidewall of the housing and the outward-facing sidewall of the jet nozzle that increases in cross-sectional area from the inlet to the outlet of the jet nozzle, first and second inlet ports in the inward-facing sidewall of the housing, each being in selective communication with a source of additive fluid, each of the first and second inlet ports having an outlet within the annulus, the first inlet port being spaced axially closer to the inlet of the jet nozzle than the second inlet port, and a venturi disposed in the discharge line.

13. The system of claim 12, further comprising an external flange on the nozzle at the inlet of the nozzle that extends from the outward-facing sidewall of the nozzle to the inward-facing sidewall of the housing.

* * * * *